US008410863B2

(12) United States Patent
Satou et al.

(10) Patent No.: US 8,410,863 B2
(45) Date of Patent: Apr. 2, 2013

(54) SLOW WAVE TRANSMISSION LINE

(75) Inventors: Junji Satou, Tokyo (JP); Shigeru Kobayashi, Tokyo (JP); Michiaki Matsuo, San Jose, CA (US)

(73) Assignee: Panasonic Corporation, Osaka (JP)

( * ) Notice: Subject to any disclaimer, the term of this patent is extended or adjusted under 35 U.S.C. 154(b) by 320 days.

(21) Appl. No.: 13/003,665

(22) PCT Filed: Jul. 15, 2009

(86) PCT No.: PCT/JP2009/003336

§ 371 (c)(1),
(2), (4) Date: Jan. 11, 2011

(87) PCT Pub. No.: WO2010/007782

PCT Pub. Date: Jan. 21, 2010

(65) Prior Publication Data

US 2011/0121913 A1 May 26, 2011

(30) Foreign Application Priority Data

Jul. 15, 2008 (JP) ..... P2008-183708

(51) Int. Cl.
*H01P 3/08* (2006.01)

(52) U.S. Cl. ..... 333/34; 333/238

(58) Field of Classification Search ..... 333/33, 333/34, 35, 238, 246, 243, 125
See application file for complete search history.

(56) References Cited

U.S. PATENT DOCUMENTS 8,183,955 B2 * 5/2012 Dolmans ..... 333/34
8,324,979 B2 * 12/2012 Cho ..... 333/4
2009/0195327 A1 * 8/2009 Cho et al. ..... 333/34

FOREIGN PATENT DOCUMENTS

JP 05-251914 A 9/1993
JP 2007306290 A 11/2007

OTHER PUBLICATIONS

Wang et al; "Confirmation of Slow Waves in a Crosstie Overlay Coplanar Waveguide an Its Applications to band-Reject Gratings and Reflectors", IEEE Transactions on Microwave Theory and Techniques, vol. 36, No. 12, IEEE, Dec. 1988, pp. 1811-1818.
Woods et al; "Novel Low-Cost On-Chip CPW Slow-Wave Structure for Compact RF Components and mm-Wave Applications", 58-th Electronic Components and Technology Conference 2008 Proceedings, IEEE, May 2008, pp. 186-190.
Amaya et al; Coplanar Waveguides in Silicon with Low Attenuation and Slow Wave Reduction, European Microwave Week 2007 Conference Proceedings, EuMA 2007, Oct. 2007, pp. 508-511.
International Search Report for PCT/JP2009/003336 dated Nov. 2, 2009.

* cited by examiner

*Primary Examiner* — Stephen Jones
(74) *Attorney, Agent, or Firm* — Pearne & Gordon LLP

(57) ABSTRACT

There is provided a low loss slow wave transmission line that can be miniaturized. A slow wave transmission line of the present invention has a configuration which includes a repeated arrangement of a low impedance line and a high impedance line and in which the high impedance line is longer than the low impedance line in terms of a line length.

9 Claims, 13 Drawing Sheets

(a)

(b)

SLOW WAVE TRANSMISSION LINE

TECHNICAL FIELD

The present invention relates to a transmission line used in a wireless communication device, such as an information terminal, and, more particularly, to a compact transmission line exhibiting a low-loss characteristic.

BACKGROUND ART

Expectations for radio communication using a millimeter wave band are recently running high. Miniaturization and cost reduction are required to use a millimeter wave band radio communication technique in consumer applications. A process using an expensive material, such as GaAs, has hitherto been applied to manufacture of a millimeter wave band RF circuit.

Incidentally, if a CMOS (Complementary Metal-Oxide Semiconductor) process can be applied to manufacture of a millimeter wave band RF (Radio Frequency) circuit, cost for manufacturing a millimeter wave band RF circuit can be curtailed. However, in a case where a circuit, such as an amplifier, is configured for a millimeter wave band, when a circuit, such as a matching circuit, is designed by means of a distributed constant circuit, an area of a passive circuit, such as a transmission line, becomes greater than an area of an active element, such as a transistor. Consequently, difficulty is encountered in miniaturizing the circuit.

A slow wave configuration has generally been known as a technique for miniaturizing a transmission line.

For instance, a proposed configuration (see; for instance, Patent Document 1) uses, as a dummy ground (Dummy Ground), strip lines that are perpendicular to a signal line and ground lines of the transmission line, and the strip lines having the same electric potential as that of the ground lines are positioned close to the signal line.

FIG. 8 is a view showing a configuration of the transmission line. Strip lines (Strip Lines) 30 perpendicular to a signal line 14 and ground lines 16*a* and 16*b* are used as a dummy ground. By means of the configuration, capacitance of the transmission line can be increased by making the dummy ground, which has the same electric potential as that of the ground lines, close to the signal line. In the configuration, the strip lines cross at right angles the signal line, whereby no electric current flows. For this reason, inductance (Inductance) L of the transmission line configured by the ground lines 16*a* and 16*b* and the signal line 14 is not reduced. Therefore, it becomes possible to make the wavelength used in the transmission line shorter and miniaturize the transmission line.

RELATED ART DOCUMENT

Patent Document

Patent Document 1: JP-A-2007-306290

DISCLOSURE OF THE INVENTION

Problem that the Invention is to Solve

However, in the configuration of the related art transmission line, the strip lines used as a dummy ground are routed such that a ratio of the width of the strip line to an interval between the strip lines comes to 1:1. Hence, characteristic impedance of the transmission line becomes worse. However, when the foregoing configuration of the transmission line is applied to an area that requires 50-ohm impedance, such as that used in an input/output port of; for instance, an MMIC (Microwave Monolithic Integrated Circuit), there will arise a problem of an extreme increase in loss.

An objective of the present invention is to shorten a wavelength in a transmission line and provide a compact yet low-loss slow wave transmission line.

Means for Solving the Problem

A slow wave transmission line of the present invention includes: a signal line that includes a first impedance line and a second impedance line, which is longer than the first impedance line in line length and which has a higher impedance than that of the first impedance line, and that is formed by repeated arrangement of the first impedance line and the second impedance line; a ground line; and a strip line that is connected to the ground line and that intersect with the signal line.

The configuration makes it possible to reduce a loss in the transmission line and miniaturize the transmission line and also make a semiconductor integrated circuit inexpensive and enhance the performance of the semiconductor integrated circuit.

In the slow wave transmission line, the signal line, the ground line, and the strip line are configured by a plurality of conductive layers and an insulating layer formed on a semiconductor substrate. Further, the first impedance line includes: a signal line which is formed in a topmost conductive layer among the plurality of conductive layers and which forms a portion of the signal line; a ground which is formed in the topmost conductive layer and which forms a portion of the ground line; an air bridge which is formed in a conductive layer positioned at one layer below the topmost conductive layer and which forms the strip line; and a via which connects the ground to the air bridge.

The configuration makes it possible to reduce the impedance of the transmission line formed on a semiconductor substrate manufactured through a semiconductor process, such as a CMOS process. Further, the configuration makes it possible to enhance a wavelength shortening effect of the slow wave transmission line and miniaturize the transmission line.

In the slow wave transmission line, the signal line, the ground line, and the strip line are configured by a plurality of conductive layers and an insulating layer formed on a semiconductor substrate. Further, the first impedance line includes: a signal line which is formed in a topmost conductive layer among the plurality of conductive layers and which forms a portion of the signal line; a ground which is formed in the topmost conductive layer and which forms a portion of the ground line; an auxiliary signal line which is formed in at least one of the plurality of conductive layers, which forms a portion of the signal line, and which is formed below the signal line; an air bridge which is formed in a conductive layer positioned at one layer below the conductive layer forming the auxiliary signal line and which forms the strip line; a via which connects the ground to the air bridge; and a short-circuit via which connects the signal line with the auxiliary signal line.

The configuration makes it possible to further reduce the impedance of the transmission line formed on a semiconductor substrate manufactured through a semiconductor process, such as a CMOS process. Further, the configuration makes it possible to further enhance the wavelength shortening effect of the slow wave transmission line and miniaturize the transmission line.

In the slow wave transmission line, the signal line, the ground line, and the strip line are configured by the plurality of conductive layers and an insulating layer formed on the semiconductor substrate. Further, the second impedance line includes: a signal line which is formed in the topmost conductive layer among the plurality of conductive layers and which forms a portion of the signal line; and a ground which is formed in a lowermost metal layer and which forms a portion of the ground line.

The configuration makes it possible to increase the impedance of the transmission line formed on a semiconductor substrate manufactured through a semiconductor process, such as a CMOS process. Further, the configuration makes it possible to enhance the wavelength shortening effect of the slow wave transmission line and miniaturize the transmission line.

In the slow wave transmission line, the signal line, the ground lines, and the strip lines are configured by the plurality of conductive layers and an insulating layer formed on the semiconductor substrate. Further, the second impedance line includes: a signal line which is formed in a conductive layer below the topmost conductive layer among the plurality of conductive layers and which forms a portion of the signal line; and a ground which is formed in the lowermost conductive layer among the plurality of conductive layers and which forms a portion of the ground line.

The configuration makes it possible to further increase the impedance of the transmission line formed on a semiconductor substrate manufactured through a semiconductor process, such as a CMOS process. Further, the configuration makes it possible to further enhance the wavelength shortening effect of the slow wave transmission line and miniaturize the transmission line.

The slow wave transmission line has a configuration in which a slit is formed in the signal line forming the first impedance line.

The configuration makes it possible to set a line width of the low impedance line (a first impedance line) without being bound to a CMOS process rule. Therefore, a flexibility of an impedance value of the low impedance line is increased, and further miniaturization of the transmission line as the slow wave transmission line becomes possible.

In the slow wave transmission line, a two branch circuit which branches or combines the slow wave transmission line is provided with an impedance adjustment element having a function of adjusting so as to match an impedance of the slow wave transmission line with an impedance of the two branch circuit.

The configuration makes it possible to reduce a loss attributable to an impedance difference occurred in the branch. A compact, low loss circuit using a slow wave transmission line can be formed.

In the slow wave transmission line, a configuration including a bend formed in the slow wave transmission line is provided with a phase adjustment element capable of adjusting an amount of phase rotation of an interior side of the bend and an amount of phase rotation of an exterior side of the bend.

The configuration makes it possible to adjust an amount of phase rotation of the interior side of the bend and an amount of phase rotation of the exterior side of the bend; hence, the slow wave transmission line can be bent with a few loss.

So long as a semiconductor integrated circuit is manufactured by use of the slow wave transmission line, the semiconductor integrated circuit can be produced inexpensively and in a compact manner.

Advantage of the Invention

According to the slow wave transmission line of the present invention, a first impedance line and a second impedance line that is higher than the first impedance line in terms of an impedance are alternately arranged, whereby a slow wave transmission line configuration yielding a wavelength shortening effect can be realized. Further, a ratio of a line length of the second impedance line to a line length of the first impedance line is adjusted. A total impedance of the slow wave transmission line is set to about 50 ohms, thereby reducing a loss. Therefore, a compact, low loss transmission line can be formed.

MODES FOR IMPLEMENTING THE INVENTION

Embodiments of the present invention will be hereunder described by reference to the drawings.

The embodiments are assumed to be applied to a CMOS process including stacking a plurality of conductive layers, insulating layers, semiconductor layers, and the like, and etching the layers in desired patterns. However, the present invention is not limited to the CMOS process but is also applicable to various semiconductor processes.

In the embodiments of the present invention, a transmission line is described as a coplanar line. The transmission line structurally includes at least a plurality of conductive layers and insulating layers. In addition to a metal layer, a polysilicon conductive film or various conductive films are also applicable as the conductive layer. Various metals, such as aluminum and copper, can be used as a material for the metal layers.

First Embodiment

Figure 1:
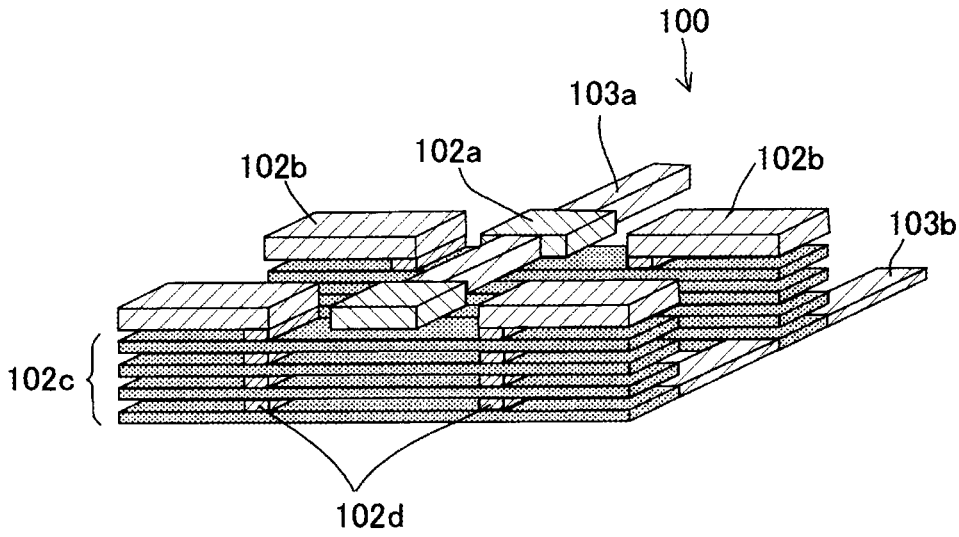
FIG. 1(*a*) is an oblique perspective view showing a diagrammatic configuration of a slow wave transmission line of a first embodiment of the present invention, and FIG. 1(*b*) it is a top view showing the same.
Figure 1:
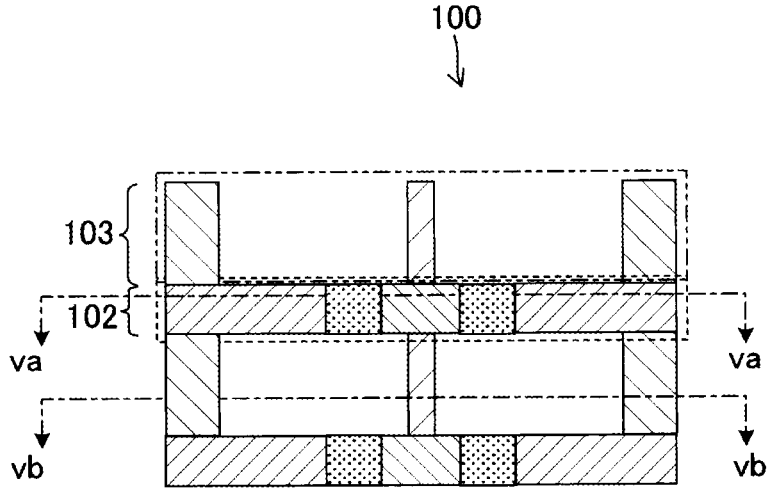

FIG. 1 is a schematic diagram of a slow wave transmission line 100 of a first embodiment of the present invention. FIG. 1(*a*) is an oblique perspective view, and FIG. 1(*b*) is a top view.

As shown in FIG. 1(*b*), the slow wave transmission line 100 includes a low impedance line 102 (a first impedance line of the present invention) and a high impedance line 103 (a second impedance line of the present invention) connected to the low impedance line 102.

As shown in FIG. 1(*a*), the low impedance line 102 includes a signal line 102*a*, ground lines 102*b*, and an air bridge 102*c*. The air bridge 102*c* is positioned below the low impedance line 102. The high impedance line 103 includes a signal line 103*a* and ground lines 103*b*. Vias 102*d* connect the ground lines 102*b* to the air bridge 102*c* of the low impedance line 102.

Figure 8:
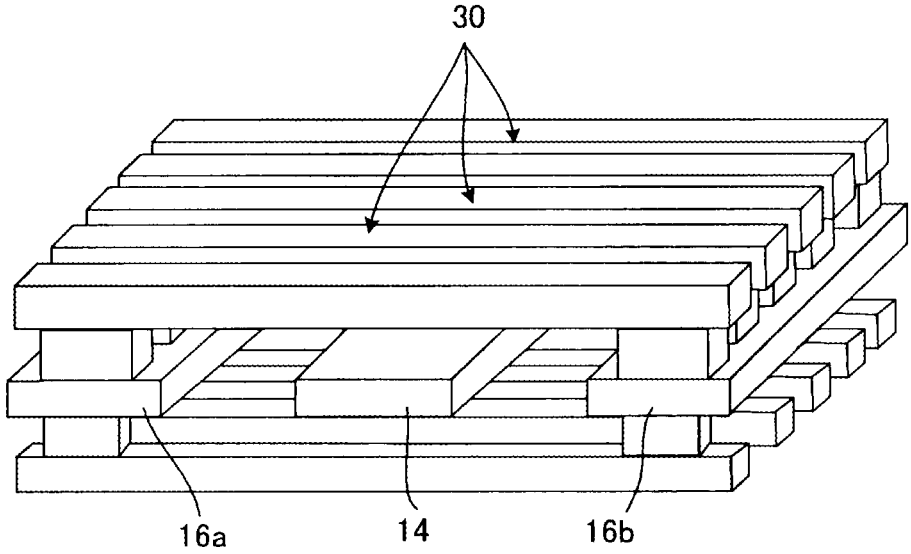
FIG. 8 It is a diagrammatic structural view of a related art transmission line.

In the low impedance line 102, the signal line 102*a* and the ground lines 102*b* form a coplanar line. As will be described later, the air bridge 102*c* is used for bringing the ground lines 102*b* on both sides of the coplanar line into the same electric potential. The air bridge acts also as a strip line forming the dummy ground described in connection with FIG. 8 of Patent Document 1.

Specifically, by means of such a configuration, the strip line forming the air bridge 102*c* having the same electric potential as that of the ground lines 102*b* can be made closer to the signal line 102*a*, whereby capacitance of the transmission line can be increased. Moreover, the strip line of the air bridge 102*c* crosses the signal line 102*a* at right angles, so that no electric current flows into the strip line. Therefore, inductance made up of the signal line 102*a* and the ground lines 102*b* is not diminished.

In the high impedance line 103, the signal line 103*a* and the ground lines 103*b* are arranged while separated from each other in the vertical direction by way of the air bridge 102*c*, as will be described later. By means of such a configuration, predetermined impedance is assured.

Operation of the slow wave transmission line 100 of the first embodiment of the present invention shown in FIG. 1 is hereunder described.

Figure 2:
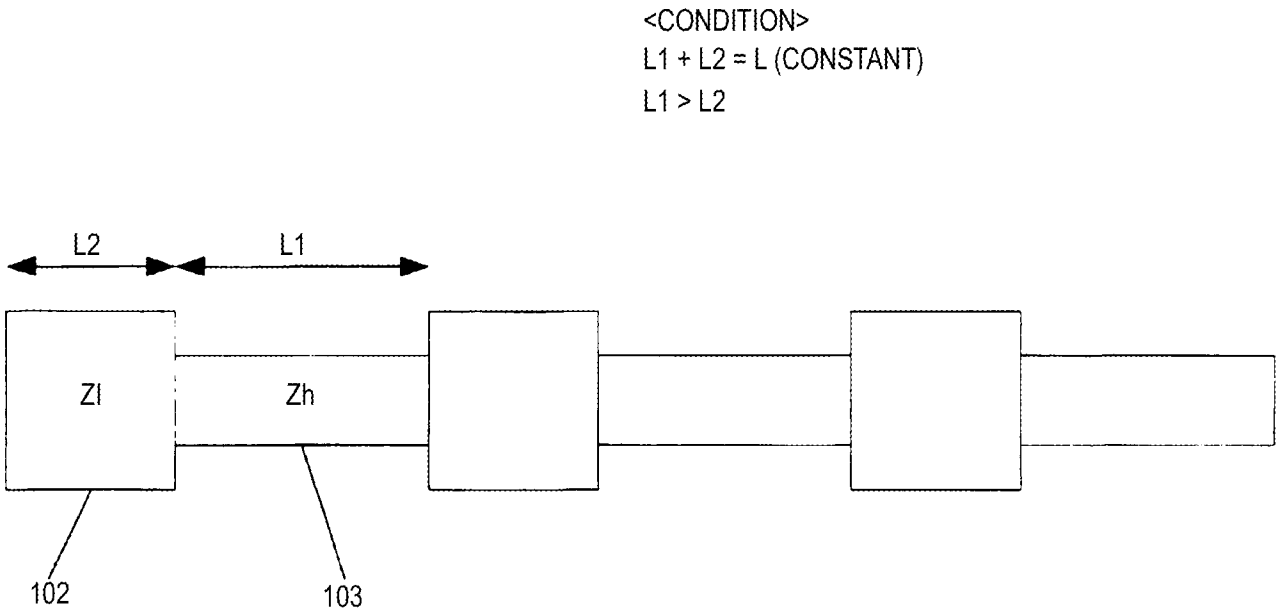
FIG. 2 It is a conceptual rendering showing a principle of the slow wave transmission line of the first embodiment of the present invention.

FIG. 2 is a conceptual rendering of the slow wave transmission line 100 of the first embodiment of the present invention. As shown in FIG. 2, the signal line of the slow wave transmission line 100 of the first embodiment of the present invention includes alternate, repeated arrangement of the signal line 102*a* of the low impedance line 102 and the signal line 103*a* of the high impedance line 103 connected to the signal line 102*a* of the low impedance line 102.

One periodic length of a repeated structure including the signal line 102*a* (a line length L2) of the low impedance line 102 and the signal line 103*a* (a line length L1) of the high impedance line 103 is assumed to be L (=L1+L2). On the basis of the assumption, settings are made such that the line length L1 of the high impedance line 103 becomes larger than the line length L2 of the low impedance line 102. A reason for setting the line lengths is now provided by comparison with a case where the signal lines are formed by means of a configuration in which the line length L2 of the low impedance line and the line length L1 of the high impedance line are repeated at a ratio of 1:1.

In general, when a transmission line is formed by use of the CMOS process, the transmission line is formed by use of the topmost layer including the thickest metal, in consideration of a skin effect or a conductor loss.

When a transmission line using the topmost metal layer is formed, a low impedance line having an impedance of about 10 ohms can be realized by means of; for instance, broadening the width of the signal line or shortening a distance from the ground lines to the signal line. In the meantime, as compared with the low impedance line, the high impedance line must be given a reduction in the width of the signal line. However, when the width of the signal line is reduced, difficulty is encountered because of restrictions on a signal line formation process and a limitation on minimization of the width of the signal line, so that only a high impedance line having an impedance of about 90 ohms can be implemented in reality.

As shown in FIG. 2, a repeated structure of signal line is formed from the low impedance line (impedance Z1 and a signal line length L2) and the high impedance line (impedance Zh and a signal line length L1) such that a ratio of the line length L2 to the signal line length L1 comes to 1:1. When the impedance Zh of the high impedance line is 90 ohms and the impedance Z1 of the low impedance line is 10 ohms, like a general example, impedance of the entire signal line comes to about $\sqrt{(Z1 \times Zh)}=30$ ohms. The signal line is difficult to use as a 50-ohm line. Thus, it is restricted to increase the impedance of the signal line under the related art method.

However, according to the first embodiment, the impedance of the entire signal line (corresponding to one period of the repeated structure of the signal line) can be adjusted by changing the ratio of the signal line length L2 of the low impedance line 102 to the signal line length L1 of the high impedance line 103.

For instance, even when the impedance Zh of the high impedance line 103 is 90 ohms and when the impedance Z1 of the low impedance line 102 is 10 ohms, like the foregoing case, the impedance of the entire signal line can be caused to approximate to 50 ohms by setting the signal line length L1 of the high impedance line 103 so as to become greater than the signal line length L2 of the low impedance line 102, so that the signal line can be used as the 50-ohm line (see FIG. 2).

Figure 3:
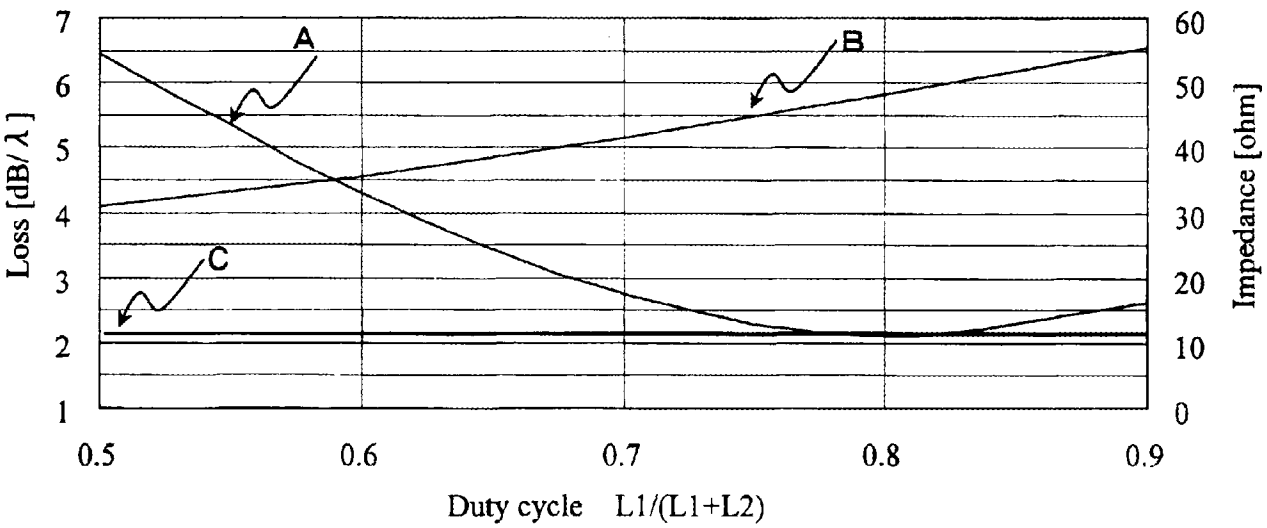
FIG. 3 It is a graph showing an example characteristic of the slow wave transmission line of the first embodiment of the present invention.

FIG. 3 shows a result of a simulation performed in connection with impedance (a right vertical axis) of the entire signal line (one period of the repeated structure of the signal line) as well as with a signal line loss (a left vertical axis) plotted against the ratio of the signal line length L1 of the high impedance line to the signal line length L2 of the low impedance line. The ratio of the signal line length L1 of the high impedance line to the signal line length L2 of the low impedance line is herein defined as "Duty cycle=L1/(L1+L2)" (a horizontal axis). A signal line loss is converted into a loss per wavelength.

A solid line A shown in FIG. 3 shows a signal line loss relative to the Duty cycle of the first embodiment. A solid line B shows an impedance of the entire signal line relative to the Duty cycle of the first embodiment. Further, a solid line C shown in FIG. 3 shows a signal line loss relative to the Duty cycle of a normal 50-ohm line. The loss is constant at 2.1 dB/h.

When the Duty cycle is set to about 0.8 based on the solid lines B and C shown in FIG. 3, it is seen that the impedance of the entire transmission line can be set to about 50 ohms and that a line loss can be suppressed to about 2.1 dB/h that is approximately equal to that of the normal 50-ohm line. Therefore, the line loss can be suppressed to about the same level as that of the normal 50-ohm line, so long as the Duty cycle is approximately set.

Figure 4:
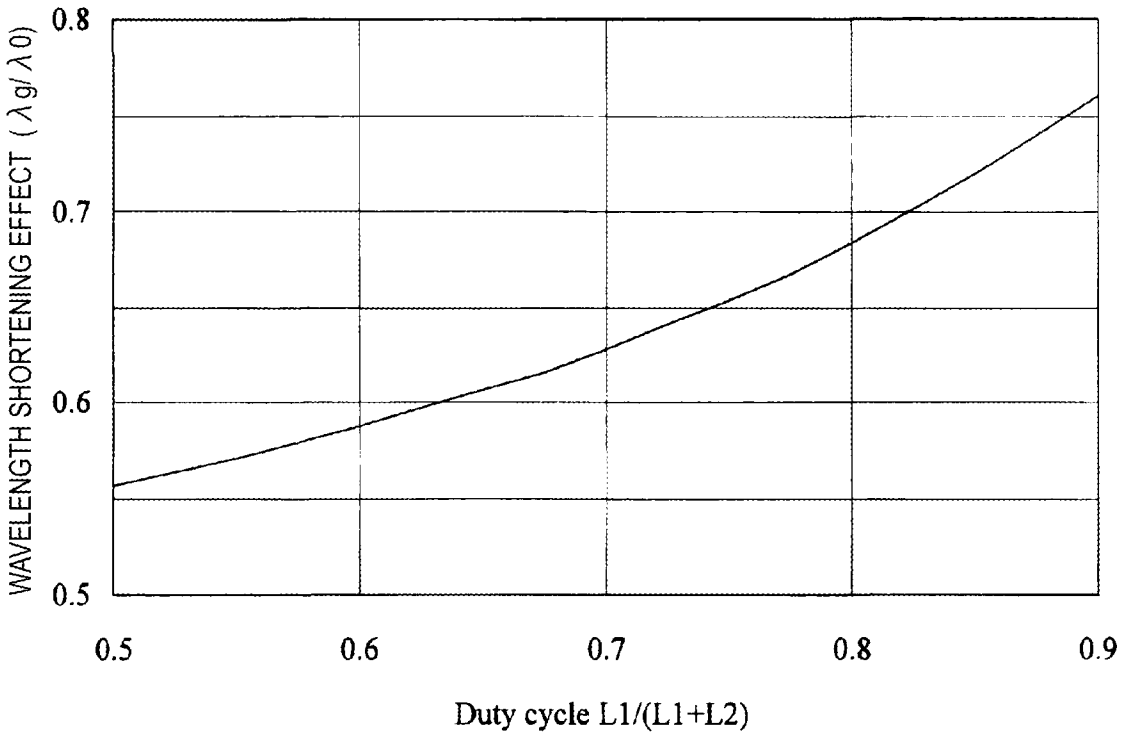
FIG. 4 It is a graph showing another example characteristic of the slow wave transmission line of the first embodiment of the present invention.

FIG. 4 shows a result of a simulation of a wavelength shortening effect (a vertical axis) relative to the ratio of the signal line length L1 of the high impedance line to the signal line length L2 of the low impedance line.

Like FIG. 3, FIG. 4 shows that the ratio of the signal line length L1 of the high impedance line to the signal line length L2 of the low impedance line is defined as "Duty cycle=L1/(L1+L2)" (a horizontal axis). A wavelength shortening ratio shown in FIG. 4 (a vertical axis) shows a wavelength shortening ratio ($\lambda/\lambda 0$) achieved when the wavelength of the signal line is compared with a wavelength $\lambda 0$ of the normal 50-ohm line. As shown in FIG. 4, when the Duty cycle is set to 0.8, a wavelength shortening effect can be set to about 0.68.

In the first embodiment, the Duty cycle is set on the basis of the simulation result shown in FIGS. 3 and 4 in such a way that the line impedance of the entire signal line comes to about 50 ohms. It is seen that the wavelength can be shortened by about 32% while the line loss is held substantially the same as that of the normal 50-ohm line occurred at the Duty cycle. Therefore, in the first embodiment, a compact yet low loss 50-ohm transmission line can be accomplished.

In the first embodiment, an example configuration of the low impedance line 2 and the high impedance line 3 formed in the CMOS process is now described by reference to FIG. 5.

Figure 5:
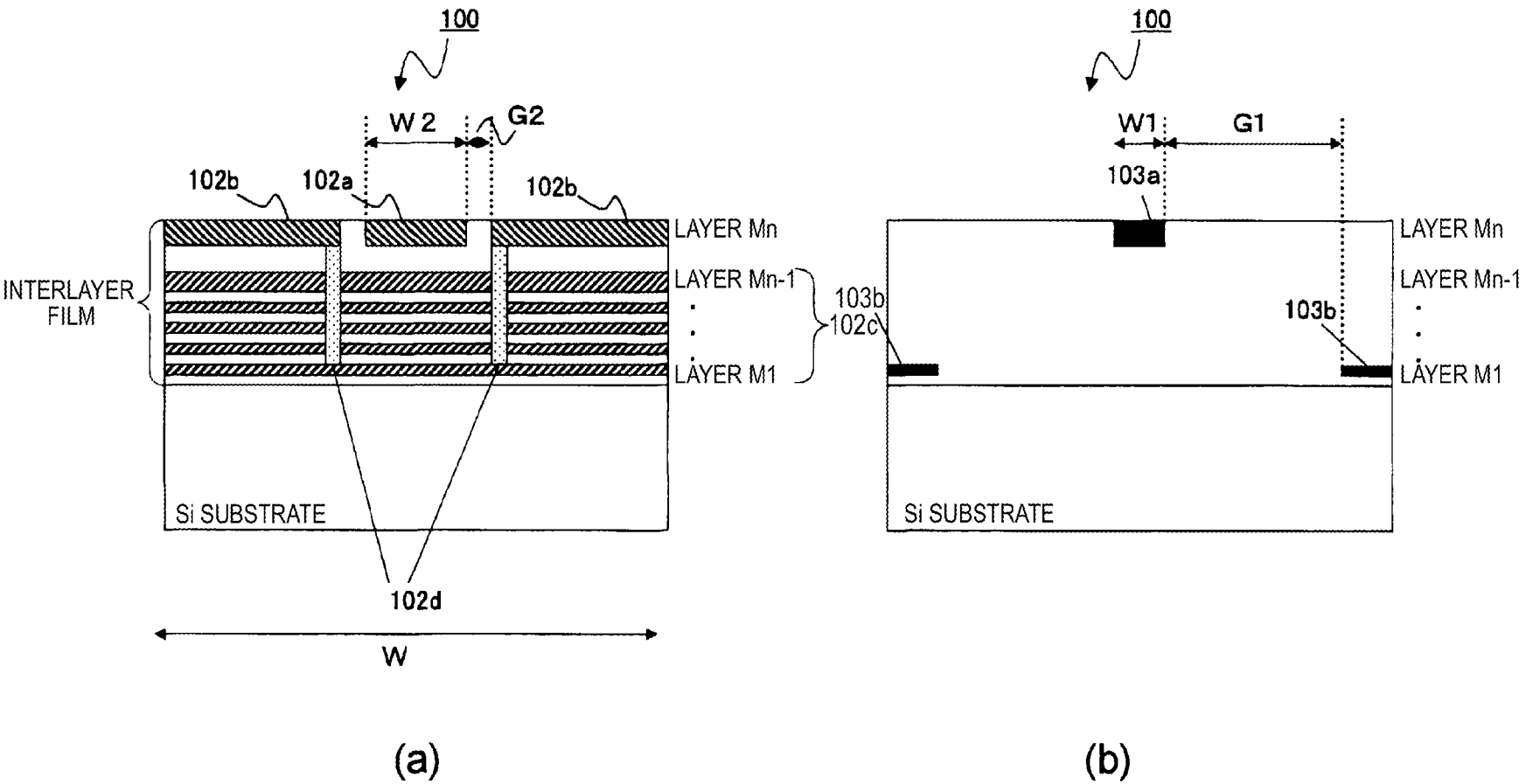
FIG. 5(*a*) is a cross sectional view of a low impedance line structure forming the slow wave transmission line of the first embodiment of the present invention, the view being taken along a line Va-Va in FIG. 1(*b*), and FIG. 5(*b*) is a cross sectional view of a high impedance line structure forming the same, the view being taken along a line Vb-Vb in FIG. 1(*b*).

FIG. 5(*a*) shows a cross-sectional view of the low impedance line 2 of the first embodiment, and FIG. 5(*b*) shows a cross-sectional view of the high impedance line 3 of the first embodiment.

As shown in FIG. 5, each of the signal line 102*a* and the ground lines 102*b* of the low impedance line 102 is formed by use of metal of the topmost layer (a layer Mn) achieved in the CMOS process. The air bridge 102*c* is formed so as to become perpendicular to the signal line 102*a*, by use of layers extending from the lowermost layer (a layer M1) to a Mn-1 layer that is lower than the topmost layer by one layer. The ground lines 102*b* and the air bridge 102*c* are connected together by use of the vias 102*d*.

The air bridge 102*c* is usually used for bringing the ground lines 102*b* on both sides of the coplanar line into the same electric potential. Further, in order to minimize the influence of the air bridge to the signal line 102*a*, the air bridge 102*c* is generally placed at the lowermost layer (the layer M1 in FIG. 5(*a*)). However, in the first embodiment, capacitance between the air bridge 102*c* and the signal line is increased by forming the air bridge 102*c* by using the layers from M1 to Mn-1. As a result, the low impedance line 102 can be formed.

A gap G2 between the signal line 102*a* and the ground line 102*b* is narrowed to a minimum gap defined in connection with; for instance, the CMOS process, whereby an impedance of the gap can be reduced.

Meanwhile, in the high impedance line 103, the signal line 103*a* is laid in the layer Mn, and the ground lines 103*b* are laid in the layer M1. A high impedance can be accomplished by narrowing the width W1 of the signal line 103*a* to a minimum line width specified in connection with the CMOS process and broadening the gap G1 between the signal line 103*a* and the ground line 103*b* as large as possible.

An electric current usually flows into the ground lines 103*b* of the coplanar line. For this reason, in order to decrease the loss of the line, the ground lines 103*b* of the coplanar line are generally placed in the same layer Mn where the signal line 103*a* is laid. However, in order to enhance the wavelength shortening effect to a much greater extent, increasing the impedance of the high impedance line 103 as high as possible is effective.

In the configuration of the first embodiment, the ground lines 103*b* of the coplanar line are laid in the layer M1 in order to further enhance the wavelength shortening effect, whereby the distance between the signal line 103*a* and the ground line 103*b* is increased. A characteristic result illustrated in FIG. 3 shows that a loss that is substantially equal to that occurred in the normal 50-ohm line occurs in the coplanar line. Therefore, even when the ground lines 103*b* of the coplanar line are laid in the layer M1, deterioration of the loss is not observed.

The reason for this is that the ground lines 103*b* do not substantially contribute to the high impedance line 103 and that the high impedance line acts as an inductor formed solely from the signal line 103*a*. Therefore, the ground lines 103*b* become obviated as constituent elements of the high impedance line 103. However, in order to interconnect the ground lines 102*b* of the respective low impedance lines 102 located before and after the high impedance line 103, the ground lines 103*b* are necessary.

A dimension of the low impedance line 102 and a dimension of the high impedance line 103 are now described. A rule called a metal density rule is provided for the CMOS process. The rule defines a ratio of metal in each layer on a CMOS chip. The rule prohibits one-sided arrangement of metal in a semiconductor chip. Specifically, the rule prohibits a density of metal that is lower than a predetermined value (the minimum density) in a chip. Likewise, the maximum density is also defined. Metal is also prohibited from being arranged in excess of the maximum density.

For instance, the rule defines that an area of metal measuring A microns square ranges from B % to C %. Accordingly, when the area of metal is deficient, the rule must be satisfied by arranging dummy metal. However, dummy metal usually causes deterioration of a characteristic of the transmission line. For this reason, a transmission line free from dummy metal is desirable.

Provided that the length of the air bridge 102*c* of the low impedance line 102 is L2 and that the width of the same is W2, an area of the air bridge 102*c* in each layer comes to (L2×W2). The high impedance lines 103 are laid before and after the low impedance line 102, and no air bridge exists below the high impedance line 103.

In the first embodiment, an area of metal measuring (L2×W) is present in an area, which measures L long and W wide, within one period of the repeated structure of the slow wave transmission line 100. Therefore, so long as the area (L2×W) of the air bridge 102*c* located below the low impedance line 102 satisfies the density rule, there is no necessity for placing dummy metal, and hence the characteristic of the transmission line will not be deteriorated. Specifically, in the area measuring A microns square, the only requirement is to set the line length of the low impedance line 102 and the line length of the high impedance line 103 so as to satisfy (Expression 1) provided below.

[Mathematical Expression 1]

$$B \leqq (L2 \times W)/((L1+L2) \times W) = L2/L \leqq C \quad \text{(Expression 1)}$$

According to the first embodiment, the slow wave transmission line 100 includes the low impedance line 102 and the high impedance line 103 that are repeatedly laid on a semiconductor substrate manufactured through the CMOS process. In the configuration of the slow wave transmission line, the line length L1 of the high impedance line 103 is greater than the line length L2 of the low impedance line 102, whereby total impedance of the transmission line is set to about 50 ohms. As a result, a low loss slow wave transmission line exhibiting a wavelength shortening effect can be implemented.

In connection with the configuration of the low impedance line 102, the signal line 102*a* and the ground lines 102*b* are formed in the topmost layer. The air bridge 102*c* is formed by use of a plurality of layers positioned blow the layer making up the signal line 102*a*. In connection with the configuration of the high impedance line 103, the signal line 103*a* is formed in the topmost layer, and the ground lines 103*b* are formed in the lowermost layer. The low impedance line 102 and the high impedance line 103 can be formed on the semiconductor substrate fabricated through the CMOS process.

Moreover, the ratio of the line length L2 of the low impedance line 102 to the line length L1 of the high impedance line 103 is set according to the foregoing (Expression 1) so as to satisfy the density rule of the CMOS process. A necessity for laying dummy metal is thereby obviated, and the slow wave transmission line 100 can be formed without involvement of deterioration of a transmission characteristic.

Further, a semiconductor integrated circuit having the slow wave transmission line described in the first embodiment is formed. It is possible to miniaturize a passive circuit for a millimeter wave band, or the like, at which difficulty is encountered in providing a matching circuit, or the like, with a lumped constant. As a consequence, a semiconductor integrated circuit can be miniaturized.

In the first embodiment, the air bridge 102*c* is arranged so as to extend from the layer M1 to the layer Mn-1. However, there can also be adopted a configuration in which the air bridge 102*c* is arranged so as to extend from a layer Mk (K≧2) to a layer Mn-1. The ground lines 103*b* of the high impedance line 103 must be placed in the layer Mk. The reason for this is that the ground lines 103*b* of the high impedance line 103 implement a role in interconnecting the ground lines 102*b* of the respective low impedance lines 102.

Second Embodiment

Figure 6:
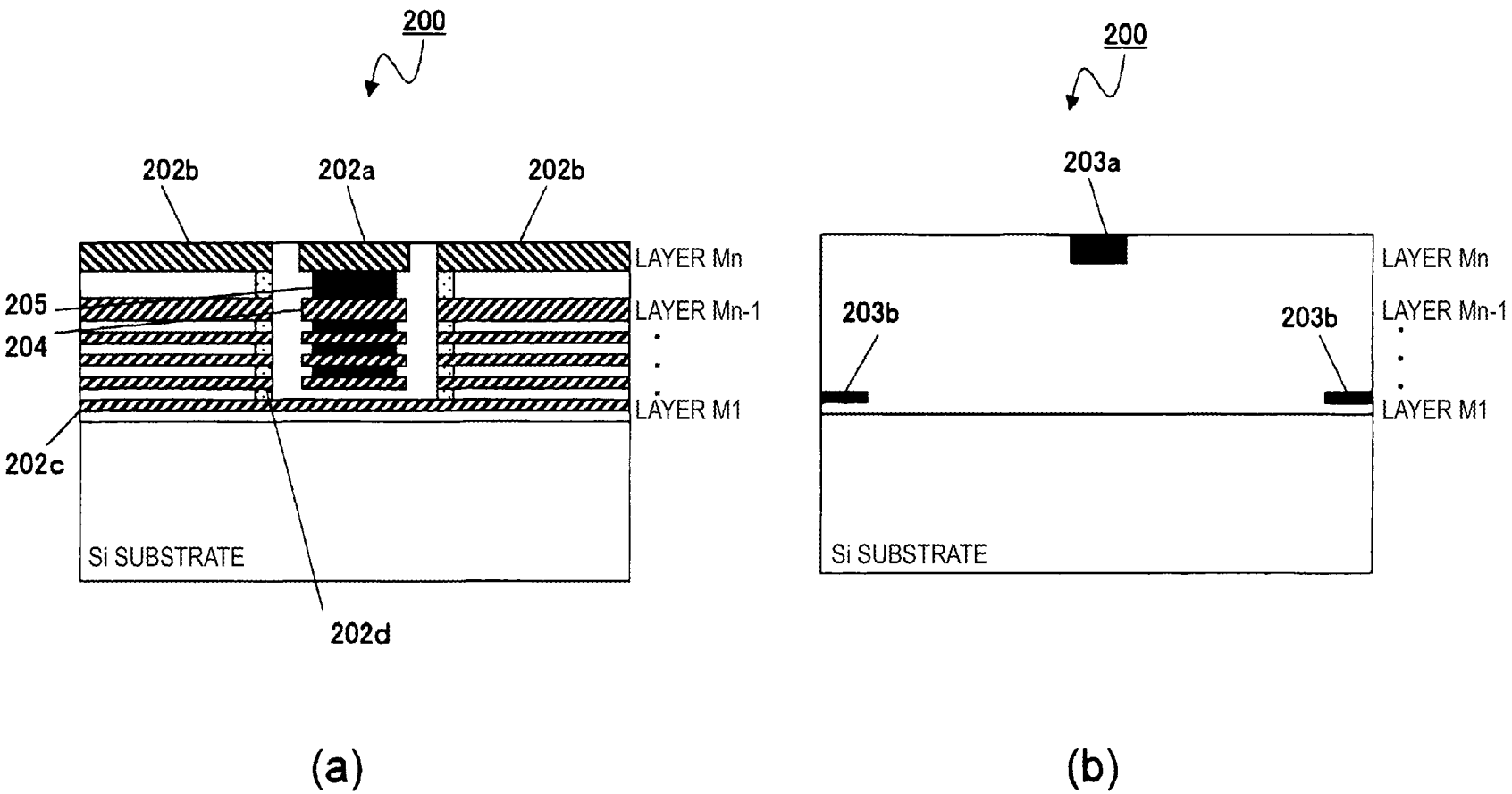
FIG. 6(*a*) is a cross sectional view of a low impedance line structure forming a slow wave transmission line of a second embodiment of the present invention, and FIG. 6(*b*) is a cross sectional view of a high impedance line structure forming the same.

FIG. 6 is a view showing a structure of a slow wave transmission line 200 of a second embodiment of the present patent application. FIG. 6(*a*) shows a cross sectional view of a low impedance line, and FIG. 6(*b*) shows a cross sectional view of a high impedance line. In FIG. 6, explanations of the elements having the same configurations as those of their counterparts described in connection with the first embodiment are omitted.

In FIG. 6, an auxiliary signal line 204 is placed below a signal line 202*a* of a low impedance line 202 (equivalent to the first impedance line of the present invention). A short-circuit via 205 connects the signal line 202*a* of the low impedance line 202 to the auxiliary signal line 204. The high impedance line (equivalent to the second impedance line of the present invention) has a similar configuration as that of its counterpart described in connection with the first embodiment, and its explanation is omitted.

Operation of the slow wave transmission line is now described by reference to a configuration, such as that mentioned above.

When the auxiliary signal line 204 is formed below the signal line 202*a* of the low impedance line 202 and when the signal line 202*a* and the auxiliary signal line 204 are connected together by means of the short-circuit via 205, the auxiliary signal line 204 is placed so as to extend from a layer M2 to a layer Mn-1. Meal layers from the layer M2 to the layer Mn thereby come to be employed as a signal line. Since an air bridge 202*c* is present in the layer M1 at this time, a value of capacitance existing between the air bridge 202*c* and the signal line comes to be determined by a value of capacitance existing between the auxiliary signal line 204 placed in the layer M2 and the air bridge 202*c*. Ground lines 202*b* are connected to the air bridge 202*c* by way of the metal layers from the layer Mn-1 to the layer M2 and vias 202*d* in such a way that the air bridge 202*c* becomes perpendicular to the signal line 202*a*.

In the CMOS process, the top metal has a large thickness, and hence spacing between the layer Mn and the layer Mn-1 also becomes large correspondingly. Spacing between metal layers becomes increasingly smaller toward the lowermost metal layer. As the signal line becomes closer to the lowermost metal layer, a greater value of capacitance existing between the air bridge and the signal line can be acquired.

In the second embodiment, since the auxiliary signal line 204 is laid up to the layer M2 close to the bottom layer, as mentioned previously, the value of capacitance existing between the air bridge 202*c* and the signal line can be made greater than that described in connection with the first embodiment. As a consequence, the impedance of the slow wave transmission line can be made smaller than that of the slow wave transmission line described in connection with the first embodiment.

As mentioned above, in the second embodiment, when the Duty cycle is set such that the line impedance of the entire signal line comes to about 50 ohms as in the first embodiment, a wavelength shortening effect can be yielded with substantially the same loss as that occurred in the normal 50-ohm line at the Duty cycle. Moreover, according to the second embodiment, the auxiliary signal line 204 is placed below the signal line 202*a* of the low impedance line 202, and the signal line 202*a* and the auxiliary signal line 204 are connected together by means of the short-circuit vias. As a result, the configuration makes it possible to decrease the impedance of the low impedance line 202 making up the slow wave transmission line 200. It is possible to yield a wavelength shortening effect that is greater than the wavelength shortening effect yielded in the first embodiment that is shown in FIG. 4 while compared with the wavelength λ0 of the normal 50-ohm line.

In the second embodiment, specifically the ratio of the line length L2 of the low impedance line 202 to the line length L1 of the high impedance line 203 is set according to previously mentioned (Expression 1) such that the density rule of the CMOS process is satisfied as in the first embodiment. As a result, a necessity for laying dummy metal becomes obviated, and the slow wave transmission line 200 can be configured without deterioration of its transmission characteristics.

A semiconductor integrated circuit having the slow wave transmission line described in connection with the second embodiment is configured. It thereby becomes possible to miniaturize a passive circuit for a millimeter wave band, or the like, at which difficulty is encountered in providing a matching circuit, or the like, with a lumped constant. As a consequence, a semiconductor integrated circuit can be miniaturized.

In the second embodiment, a reference has been made to the configuration in which the auxiliary signal line 204 is laid from the layer M2 to the layer Mn-1. However, the slow wave transmission line is not limited to the configuration. For instance, the essential requirement for the slow wave transmission line is that the slow wave transmission line be configured by use of metal layers; for instance, a layer Mm to a layer Mn-1 (M is two or more). Therefore, there may also be adopted a configuration in which the air bridge 202*c* is formed by use of the metal layers M1 to Mm-1.

The second embodiment has provided an explanation to the configuration in which the auxiliary signal line 204 and the signal line 202*a* are connected together by means of the short-circuit vias. However, even when there is adopted a configuration which does not employ any short-circuit vias and in which the auxiliary signal lines 204 of the respective layers are not connected to the signal lines 202*a*, capacitance arises between the auxiliary signal lines of the respective layers; hence, the wavelength shortening effect can be expected.

Third Embodiment

Figure 7:
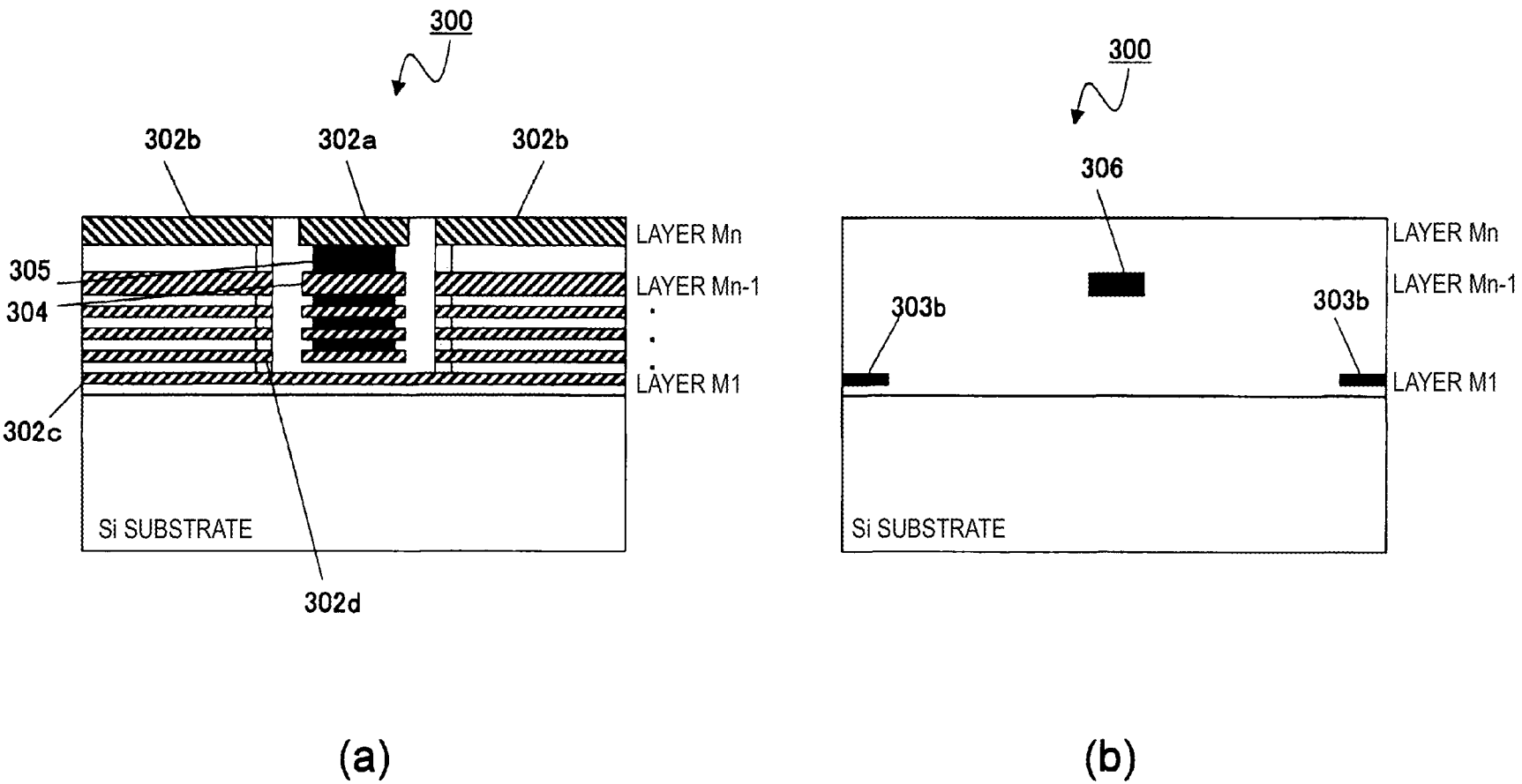
FIG. 7(*a*) it is a cross sectional view of a low impedance line structure forming a slow wave transmission line of a third embodiment of the present invention, and FIG. 7(*b*) it is a cross sectional view of a high impedance line structure forming the same.

FIG. 7 is a view showing a structure of a slow wave transmission line 300 of a third embodiment. FIG. 7(*a*) is a cross sectional view of a low impedance line, and FIG. 7(*b*) is a cross sectional view of a high impedance line. In FIG. 7, explanations of the elements having the same configurations as those of their counterparts described in connection with the second embodiment are omitted.

In FIG. 7, a low impedance line 302 (equivalent to the first impedance line of the present invention) includes a signal line 302*a* formed in the layer Mn, ground lines 302*b* formed in the layer Mn, and an air bridge 302*c* formed in the layer M1. The ground lines 302*b* and the air bridge 302*c* are connected together by way of metal layers from the layer Mn-1 to the layer M2 and vias 302*d*. The ground lines 302*b* are connected to the air bridge 302*c* by way of the metal layers from the layer Mn-1 to the layer M2 and the vias 302*d* in such a way that the air bridge 302*c* becomes perpendicular to the signal line 302*a*. A high impedance line 303 (equivalent to the second impedance line of the present invention) includes a signal line 306 formed in the layer Mn-1 and ground lines 303*b* formed in the layer M1.

Operation of the slow wave transmission line is now described by reference to a configuration, such as that mentioned above.

In normal times, the width of the line can be made increasingly narrower toward a lower layer in the CMOS process. The signal line 306 of the high impedance line 303 is placed in the lower layer Mn-1, and a line width W1 of the signal line is made narrower, whereby the impedance of the signal line can be increased. The low impedance line 302 must be given, at this time, a configuration in which the signal line 302*a* and an auxiliary signal line 304 are connected together by use of short circuit vias 305.

As mentioned above, in the third embodiment, the Duty cycle is set in such a way that the line impedance of the entire signal line comes to about 50 ohms, as in the first embodiment. A wavelength shortening effect can be yielded with substantially the same loss as that occurred in the normal 50-ohm line at the Duty cycle.

Moreover, according to the third embodiment, the signal line 306 of the high impedance line 303 is formed by use of the layer Mn-1. The impedance of the high impedance line 303 can be further increased. It is possible to yield a wavelength shortening effect that is greater than the wavelength shortening effect yielded in the first embodiment that is shown in FIG. 4 while compared with the wavelength λ0 of the normal 50-ohm line.

In the third embodiment, specifically the ratio of the line length L2 of the low impedance line 302 to the line length L1 of the high impedance line 303 is set according to previously mentioned (Expression 1) such that the density rule of the CMOS process is satisfied as in the first embodiment. As a result, a necessity for laying dummy metal becomes obviated, and the slow wave transmission line 300 can be configured without deterioration of its transmission characteristics.

A semiconductor integrated circuit having the slow wave transmission line described in connection with the third embodiment is configured. It thereby becomes possible to miniaturize a passive circuit for a millimeter wave band, or the like, at which difficulty is encountered in providing a matching circuit, or the like, with a lumped constant. As a consequence, a semiconductor integrated circuit can be miniaturized.

In the third embodiment, a reference has been made to the configuration in which the signal line 306 is laid in the layer Mn-1. However, the slow wave transmission line is not limited to the configuration. Any one of the layers from M1 to Mn-1 can also be used.

Fourth Embodiment

Figure 9:
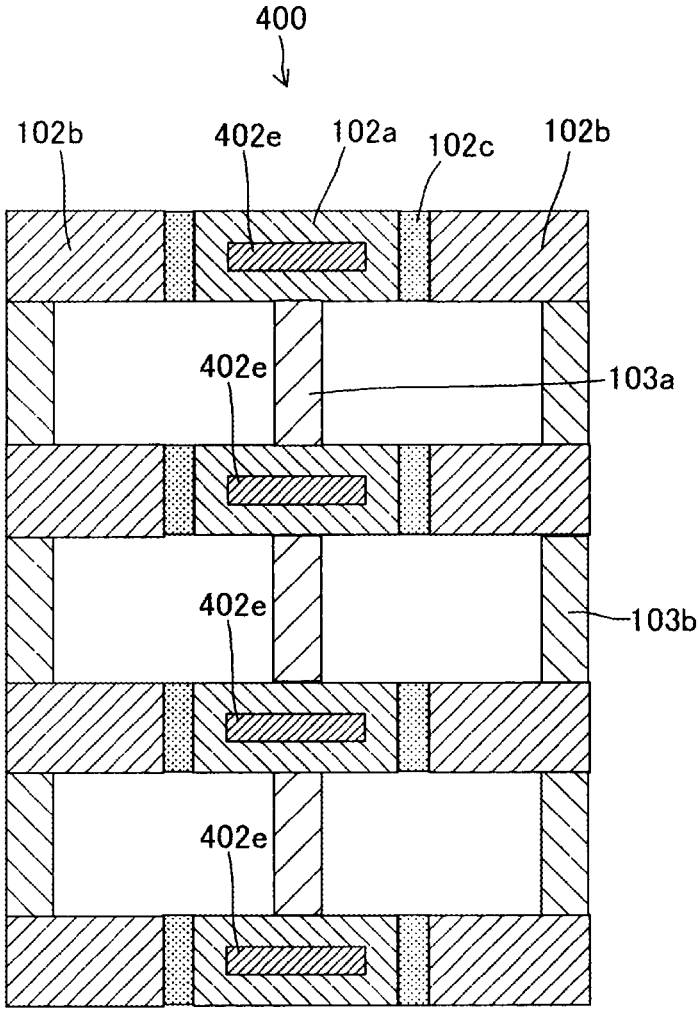
FIG. 9 It is a diagrammatic structural view of a slow wave transmission line of a fourth embodiment when viewed from above.

FIG. 9 is a diagrammatic structural view of a slow wave transmission line 400 of a fourth embodiment when viewed from above. In FIG. 9, reference numeral 402*e* designates a slit formed in the signal line 102*a* and in the layer Mn. The slow wave transmission line is structurally the same as its counterpart described in connection with the first embodiment in other respects, and hence its explanation is omitted.

Operation of the slow wave transmission line is now described by reference to a configuration, such as that mentioned above. In general, a decrease in impedance of the low impedance line 102 can be accomplished by broadening the width of the signal line 102*a*. According to the process rule of the CMOS process, difficulty is encountered in forming a line having a given width or more. For this reason, a lower limit on impedance of the low impedance line 102 is determined by the CMOS process.

However, as shown in FIG. 9, the slit 402*e* is made in the signal line 102*a* making up the low impedance line 102, whereby the width of the signal line 102*a* of the low impedance line 102 can freely be designed without being bound to the rule of the CMOS process. The slit 402*e* is placed at a center of the signal line 102*a* in its longitudinal and lateral directions, whereby an electric current flowing through an end of the signal line 102*a* is not substantially affected by the slit, so that a low loss line can be implemented.

As mentioned above, according to the present embodiment, the slit 402*e* is made in the signal line 102*a* of the low impedance line 102, whereby the impedance of the low impedance line 102 can freely be selected without being bound to the rule of the CMOS process. As a result, the wavelength shortening effect can be greatly increased.

The present embodiment has provided the explanations about the configuration in which the slit 402*e* is made in the signal line 102*a* in the layer Mn. However, as shown in connection with the second embodiment, not to mention a similar configuration can be adopted even in relation to the auxiliary signal line 204.

Fifth Embodiment

Figure 10:
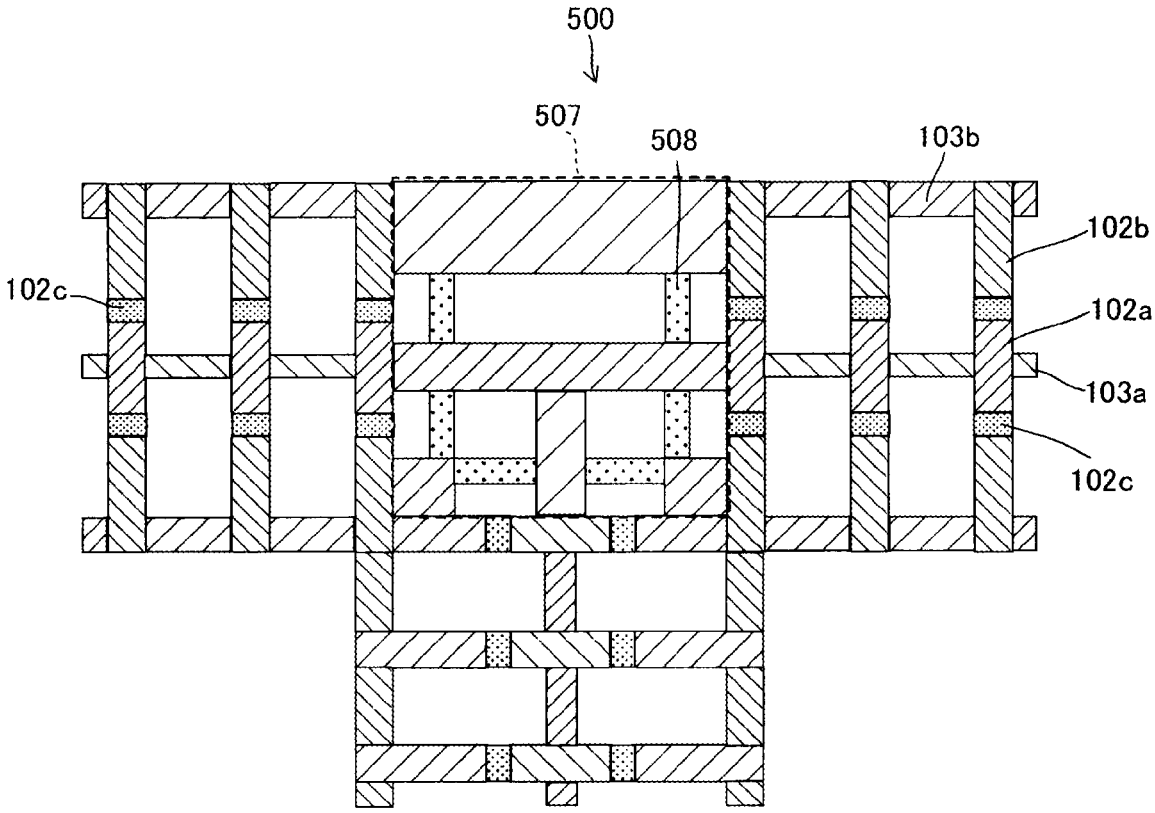
FIG. 10 It is a diagrammatic structural view of a slow wave transmission line of a fifth embodiment when viewed from above.

FIG. 10 is a diagrammatic structural view of a slow wave transmission line 500 of a fifth embodiment when viewed from above. In FIG. 10, reference numeral 507 designates a two branch circuit that divides a transmission line. The slow wave transmission line is structurally the same as its counterpart described in connection with the first embodiment in other respects, and hence its explanation is omitted.

Operation of the slow wave transmission line is now described by reference to a configuration, such as that mentioned above. In normal times, when the matching circuit using a transmission line is formed, a branch circuit using a T branch, or the like, is required. However, when a slow wave transmission line 500 is used in the transmission line, difficulty is encountered in adopting a simple branch circuit configuration. For this reason, the two branch circuit 507 is used as shown in FIG. 10, whereby the three-direction slow wave transmission line 500 can be connected smoothly.

Accordingly, the characteristic impedance of the slow wave transmission line 500 of the present embodiment is determined by the impedance of the low impedance line 102 and the impedance of the high impedance line 103. For instance, when the slow wave impedance of the transmission line 100 is Z0, impedance discontinuities can be eliminated by designing respective ports of the two branch circuit 507 in such a way that the impedance of the ports also comes to Z0. Thus, a low loss branch circuit can be configured. An air bridge 508 is added to an area in the two branch circuit 507 where ground discontinuities occur, whereby ground potentials of both sides of the slow wave transmission line can be matched.

As mentioned above, according to the present embodiment, when a branch circuit is configured by use of the slow wave transmission line 500, there is employed the two branch circuit 507 whose port impedance is identical with the impedance Z0 of the slow wave transmission line 500, whereby a low loss branch circuit can be configured. A compact, low loss semiconductor integrated circuit can be configured.

Figure 11:
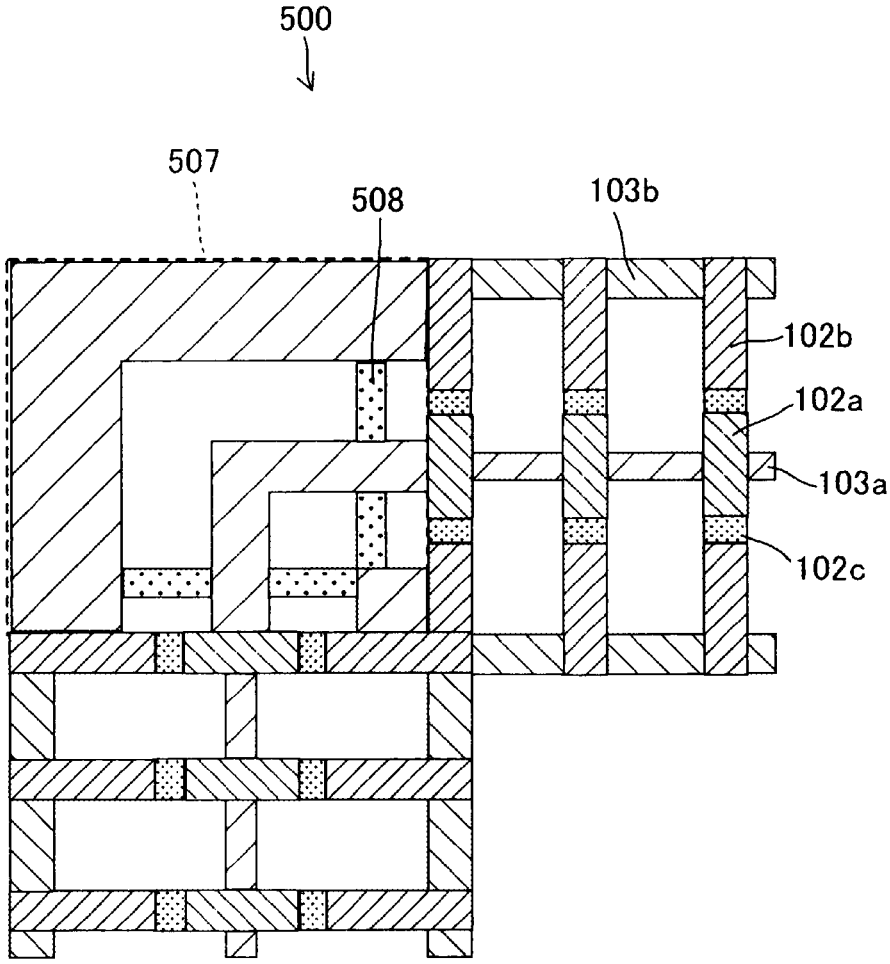
FIG. 11 It shows the slow wave transmission line of the fifth embodiment to which a 90-degree bend structure is applied.

Although the present embodiment has provided the case of the two branch circuit, the present invention can also be applied to a circuit other than the two branch circuit; for instance, a 90-degree bend structure, such as that shown in FIG. 11.

Figure 12:
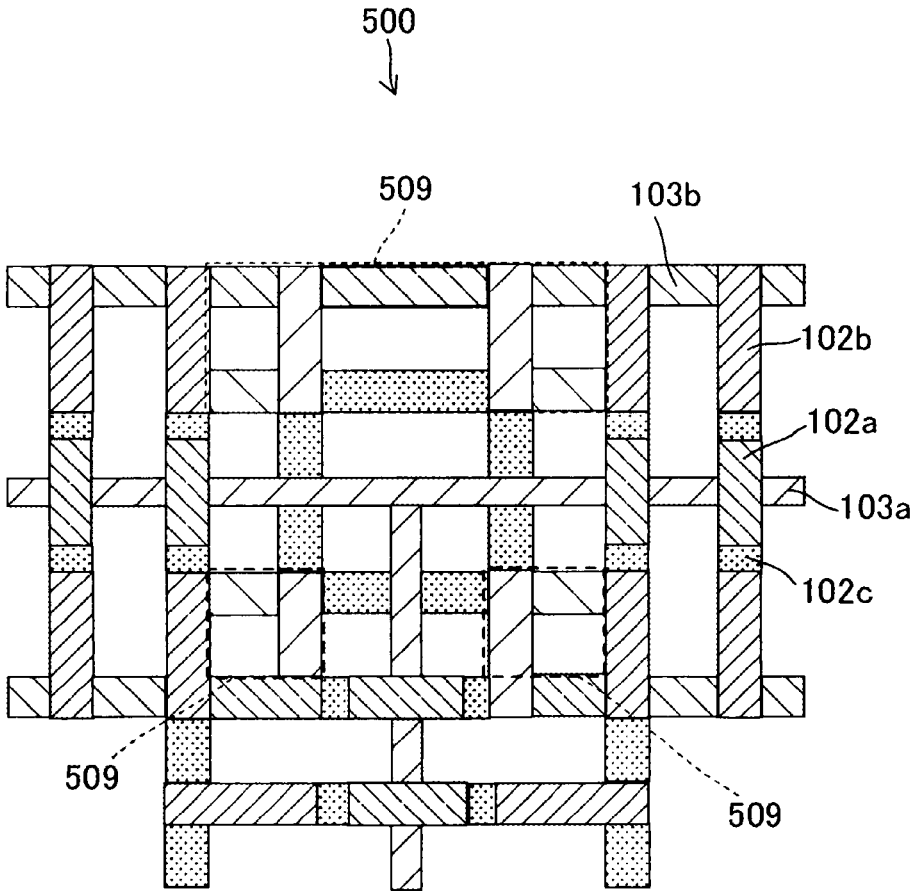
FIG. 12 It is a view showing that a signal line 103*a* of the slow wave transmission line of the fifth embodiment shown in FIG. 10 are connected in the shape of a T branch.

As shown in FIG. 12, the signal lines 103*a* of the respective slow wave transmission lines 500 can also be connected in the form of a T branch. An impedance adjustment element 509 can also be added in such a way that impedance achieved at that time can be controlled. A preferred layout of the impedance adjustment element 509 achieved at that time is a horizontally symmetrical arrangement of the impedance adjustment element with respect to each of the slow wave transmission lines 500.

Sixth Embodiment

Figure 13:
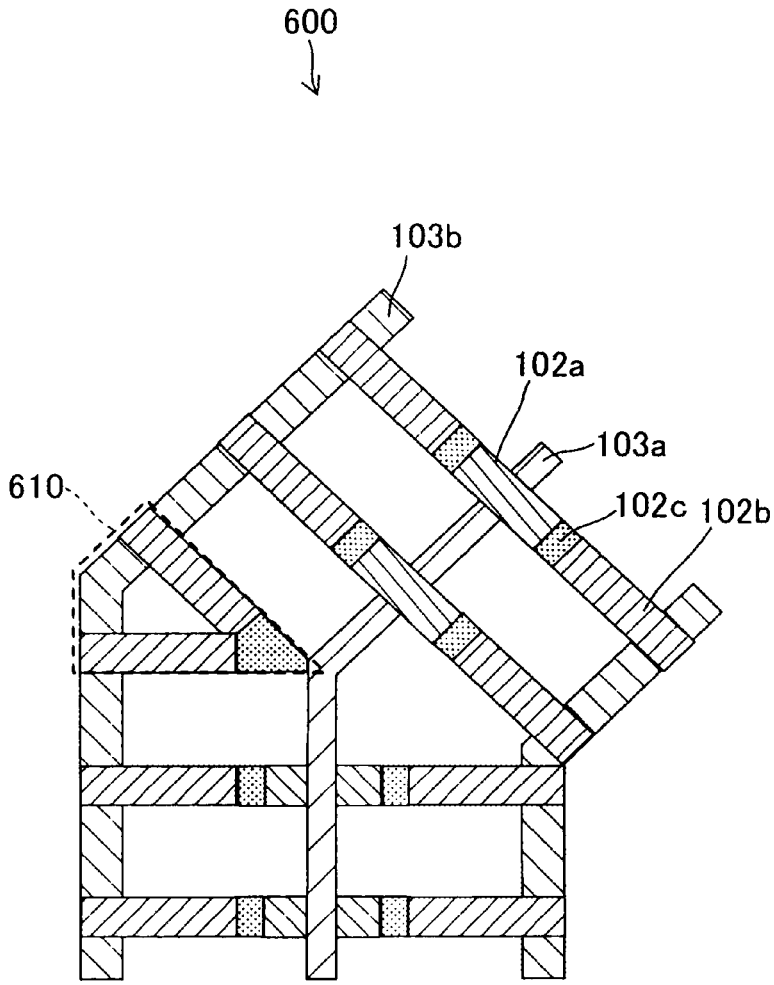
FIG. 13 It is a diagrammatic structural view of a slow wave transmission line of a sixth embodiment when viewed from above.

FIG. 13 is a diagrammatic structural view of a slow wave transmission line 600 of a sixth embodiment when viewed from above. In FIG. 13, reference numeral 610 designates a phase adjustment element for adjusting a difference between a phase of an interior side of a bend and a phase of an exterior side of the bend.

Operation of the slow wave transmission line is now described by reference to a configuration, such as that mentioned above. In order to reduce a circuit area on a CMOS, it has hitherto been commonly performed to bend a transmission line. When the transmission line is bent, an interior side of the bend and an exterior side of the bend differ from each other in terms of an electrical length. The interior side and the exterior side consequently differ from each other in terms of an amount of phase rotation, so that a balance between the right side and the left side of the transmission line is lost as a consequence, thereby resulting in a greater loss.

As shown in FIG. 13, the phase adjustment element 610 is added to the exterior side of the bend, whereby an amount of phase rotation of the exterior side of the bend is adjusted, thereby matching the amount of phase rotation of the exterior side of the bend with the amount of phase rotation of the interior side of the bend, whereby influence on the bend can be reduced. To this end, the phase adjustment element 610 is built from the layer Mn and the layer Mn-1. The amount of phase rotation of the exterior side of the bend is adjusted by changing a distance from the exterior side to the signal line 103*a*.

As mentioned above, according to the present embodiment, when the transmission line is bent by use of the slow wave transmission line 600, the phase adjustment element 610 is added to the exterior side of the bend, thereby making it possible to bend the line with a low loss and manufacture a compact, low loss semiconductor integrated circuit.

Although the present invention has been described in detail by reference to the specific embodiments, it is manifest to those skilled in the art that the present invention be susceptible to various alterations and modifications without departing the spirit and scope of the present invention.

The present patent application is based on a Japanese Patent Application (JP-2008-183708) filed on Jul. 15, 2008, the subject matters of which are incorporated herein by reference.

INDUSTRIAL APPLICABILITY

The slow wave transmission line of the present invention yields an advantage of the ability to realize a low loss transmission line while yielding a wavelength shortening effect and is useful as a transmission line in a semiconductor integrated circuit using a CMOS process, or the like, at a high frequency band like a millimeter wave band.

DESCRIPTIONS OF THE REFERENCE NUMERALS

100, 200, 300 SLOW WAVE TRANSMISSION LINE
102, 202, 302 LOW IMPEDANCE LINE
102*a*, 202*a*, 302*a* SIGNAL LINE
306 SIGNAL LINE
102*b*, 202*b* GROUND LINE
103*b*, 203*b*, 303*b* GROUND LINE
102*c*, 202*c*, 302*c* AIR BRIDGE
102*d*, 202*d*, 302*d* VIA
103, 203, 303 HIGH IMPEDANCE LINE
103*a*, 203*a* SIGNAL LINE
104, 204, 304 AUXILIARY SIGNAL LINE
105, 205, 305 SHORT-CIRCUIT VIA

The invention claimed is:

1. A slow wave transmission line comprising:

a signal line that includes a first impedance line and a second impedance line, which is longer than the first impedance line in line length and which has a higher impedance than that of the first impedance line, and that is formed by repeated arrangement of the first impedance line and the second impedance line;

a ground line; and a strip line that is connected to the ground line and that intersects with the signal line.

2. The slow wave transmission line according to claim 1, wherein the signal line, the ground line, and the strip line are configured by a plurality of conductive layers and an insulating layer formed on a semiconductor substrate; and wherein the first impedance line includes:

a signal line which is formed in a topmost conductive layer among the plurality of conductive layers and which forms a portion of the signal line;

a ground which is formed in the topmost conductive layer and which forms a portion of the ground line;

an air bridge which is formed in a conductive layer positioned at one layer below the topmost conductive layer and which forms the strip line; and a via which connects the ground to the air bridge.

3. The slow wave transmission line according to claim 1, wherein the signal line, the ground line, and the strip line are configured by a plurality of conductive layers and an insulating layer formed on a semiconductor substrate; and the first impedance line includes:

a signal line which is formed in a topmost conductive layer among the plurality of conductive layers and which forms a portion of the signal line;

a ground which is formed in the topmost conductive layer and which forms a portion of the ground line;

an auxiliary signal line which is formed in at least one of the plurality of conductive layers, which forms a portion of the signal line, and which is formed below the signal line;

an air bridge which is formed in a conductive layer positioned at one layer below the conductive layer forming the auxiliary signal line and which forms the strip line;

a via which connects the ground to the air bridge; and a short-circuit via which connects the signal line with the auxiliary signal line.

4. The slow wave transmission line according to claim 1, wherein the signal line, the ground line, and the strip line are configured by the plurality of conductive layers and an insulating layer formed on the semiconductor substrate; and the second impedance line includes:

a signal line which is formed in the topmost conductive layer among the plurality of conductive layers and which forms a portion of the signal line; and a ground which is formed in a lowermost metal layer and which forms a portion of the ground line.

5. The slow wave transmission line according to claim 1, wherein the signal line, the ground lines, and the strip lines are configured by the plurality of conductive layers and an insulating layer formed on the semiconductor substrate; and the second impedance line includes:

a signal line which is formed in a conductive layer below the topmost conductive layer among the plurality of conductive layers and which forms a portion of the signal line; and a ground which is formed in the lowermost conductive layer among the plurality of conductive layers and which forms a portion of the ground line.

6. The slow wave transmission line according to claim 1, wherein a slit is formed in the signal line forming the first impedance line.

7. The slow wave transmission line according to claim 1, wherein a two branch circuit which branches or combines the slow wave transmission line is provided with an impedance adjustment element having a function of adjusting so as to match an impedance of the slow wave transmission line with an impedance of the two branch circuit.

8. The slow wave transmission line according to claim 1, wherein a configuration including a bend formed in the slow wave transmission line is provided with a phase adjustment element capable of adjusting an amount of phase rotation of an interior side of the bend and an amount of phase rotation of an exterior side of the bend.

9. A semiconductor integrated circuit using the slow wave transmission line according to claim 1.

* * * * *